US006116437A

United States Patent [19]

Rowe

[11] Patent Number: 6,116,437

[45] Date of Patent: Sep. 12, 2000

[54] MODULAR CONSTRUCTION TOWEL RACK

[75] Inventor: Greg Rowe, Rainham, United Kingdom

[73] Assignee: Avilion Limited, Rainham, United Kingdom

[21] Appl. No.: 09/203,915

[22] Filed: Dec. 2, 1998

[30] Foreign Application Priority Data

Dec. 3, 1997 [GB] United Kingdom ..... 9725662

[51] Int. Cl.[7] ..... A47F 5/14

[52] U.S. Cl. ..... 211/189; 211/119.008; 211/182; 285/133.21

[58] Field of Search ..... 211/189, 182, 211/186, 187, 193, 119.008, 16; 285/41, 125.1, 918, 179, 133.11, 133.21, 133.3; 34/239, 225, 215, 621, 622, 619; 403/171, 172, 177

[56] References Cited

U.S. PATENT DOCUMENTS

| | | | |
|---|---|---|---|
| 1,781,581 | 11/1930 | Hellyer | 285/133.21 |
| 2,839,320 | 6/1958 | Hill | 403/172 |
| 3,074,203 | 1/1963 | Paksy | 446/120 |
| 3,144,946 | 8/1964 | Ellis | 211/182 |
| 3,751,082 | 8/1973 | Somerville | 211/182 |
| 3,851,601 | 12/1974 | Davis | 211/182 |
| 3,982,284 | 9/1976 | Becker | 4/661 |
| 4,045,060 | 8/1977 | Daigle | 285/133.21 |
| 4,112,853 | 9/1978 | Tisbo et al. | 108/190 |
| 4,625,432 | 12/1986 | Baltes | 34/621 |
| 4,815,727 | 3/1989 | Kiribuchi | 34/86 |
| 4,849,610 | 7/1989 | Alvarez | 219/521 |
| 4,858,964 | 8/1989 | Usai | 285/133.21 |
| 5,056,831 | 10/1991 | Ho | 285/133.21 |
| 5,464,257 | 11/1995 | Riddles et al. | 285/133.21 |
| 5,520,293 | 5/1996 | Hartley | 211/182 |
| 5,548,100 | 8/1996 | Miller | 34/621 X |
| 5,678,706 | 10/1997 | Husak et al. | 211/189 |
| 5,799,986 | 9/1998 | Corbett et al. | 285/133.21 |

FOREIGN PATENT DOCUMENTS

| | | |
|---|---|---|
| 0366579 | 5/1990 | European Pat. Off. . |
| 0695530 | 2/1996 | European Pat. Off. . |
| 2695466 | 3/1994 | France . |
| 2747759 | 10/1997 | France . |
| 596135 | 12/1947 | United Kingdom . |
| 1184025 | 3/1970 | United Kingdom . |
| 1463205 | 2/1977 | United Kingdom . |
| 2212037 | 7/1989 | United Kingdom . |
| 2248770 | 4/1992 | United Kingdom . |
| 2292074 | 2/1996 | United Kingdom . |
| WO88/01039 | 2/1988 | WIPO . |

*Primary Examiner*—Daniel P. Stodola
*Assistant Examiner*—Jennifer E. Novosad
*Attorney, Agent, or Firm*—Gottlieb Rackman & Reisman

[57] ABSTRACT

A towel rail (2) is assembled in modular format by having a plurality of individual pipes (4) selectively connectable with a plurality of discrete connecting pieces (6). The ends of the pipes (4) may have a chamfered recess (22) to enable a grub screw (20) to rigidly hold each pipe (4) in fluid-tight contact with a respective connector (6).

13 Claims, 2 Drawing Sheets

MODULAR CONSTRUCTION TOWEL RACK

The present invention has particular, although not exclusive, relevance to towel rail assemblies which lend themselves readily to being constructed in any design format.

It is known to form towel rails by starting with prepolished brass hollow pipes which are then braised together in the desired shape or format. Having been braised in this way, the assembly of pipes are then immersed in hot water for a period of time in order to clean off the flux which is formed around those positions where braising has occurred. Following this, the assembly is polished by hand and is then usually electroplated.

The above process is very inflexible and time consuming. Clearly, once the pipes have been braised together in their desired format, then any alteration of this is not possible without extensive reworking. Furthermore, because the flux associated with the braising process needs to be removed and polishing of the product after this undertaken by hand, then a great deal of time is required in order to be able to form a towel rail in this manner.

Because the assemblies so produced are very unwieldy and, due to the labour-intensive methods of production, it is not uncommon for damage to occur to the assembly during the process. As a result of this damage if reworking is not possible, then the whole assembly may need to be scrapped. If this occurs then clearly high expenses are incurred and it may also lead to long delivery lead times to a customer.

It is an aim of the present invention therefore to at least alleviate the aforementioned shortcomings by provision of a towel rail assembly which is of modular construction.

According to a first aspect of the present invention there is provided a modular construction towel rail comprising a plurality of pipe members, and a plurality of discrete connection pieces each of which connects together a plurality of pipe members, the connection pieces being adapted to connect pipe members in-line and/or at right angles to each other.

This enables the manufacturer to not only be able to assembly a towel rail in accordance with a customer's desired format, but also removes the need for scrapping the entire assembly, should one part of the towel rail be damaged.

Preferably, the discrete connection pieces include T-shaped connection pieces.

More preferably, one of the pipe members and the connection pieces includes a male portion and the other of the pipe members and connection pieces includes a female portion.

Preferably the connection between a pipe member and a connection piece is maintained by a locking means engaging both said a pipe and said a connection piece. In this way therefore the need to braise the pipe members and connection pieces together is avoided and once again, should any damage occur, it is simply a question of replacing the damaged piece rather than the entire assembly. Additionally or alternatively one of the said a pipe member and the said a connection piece includes a chamfered surface against which surface the locking means may abut. This provides that the connection, once formed, between the pipe and the connection piece may not readily be broken. Preferably the locking means comprises a grub screw.

In a preferred embodiment an O-ring is fitted between a pipe member and a connection piece, when connected, thereby to provide a fluid-type seal therebetween. Furthermore the O-ring may be fitted to either an end of a pipe member or an end of a connection piece (which connection piece is connected to said an end of a pipe member).

In a preferred embodiment the pipe members of the plurality of pipe members include male portions and the connection pieces of the plurality of connection pieces include female portions. Preferably the O-rings are fitted to the male portion of a pipe member.

In a second aspect, the present invention provides a kit of parts for a modular-construction towel rail comprising a plurality of pipe members, and a plurality of discrete connection pieces, each of which is adapted to connect together a plurality of pipe members, the connection pieces being adapted to connect pipe members in-line and/or at right angles to each other.

The present invention also provides a modular-construction towel rail comprising a plurality of pipe members and a plurality of connection pieces, wherein each end of each pipe member is selectively connectable with each connection piece thereby to enable a desired configuration of towel rail to be constructed, and wherein one of the pipe members and the connection pieces includes a male portion and the other of the pipe members and the connection pieces includes a female portion.

Further, the present invention provides a kit of parts for a modular-construction towel rail comprising: a plurality of pipe members; a plurality of connection pieces each connection piece of the plurality of connection pieces selectively connectable to any one of the pipe members of the plurality of pipe members; and locking members for engaging each end of each said pipe to a respective connection piece, when connected together.

The present invention will now be described, by way of example only, and with reference to the following drawings of which:

Figure 1:
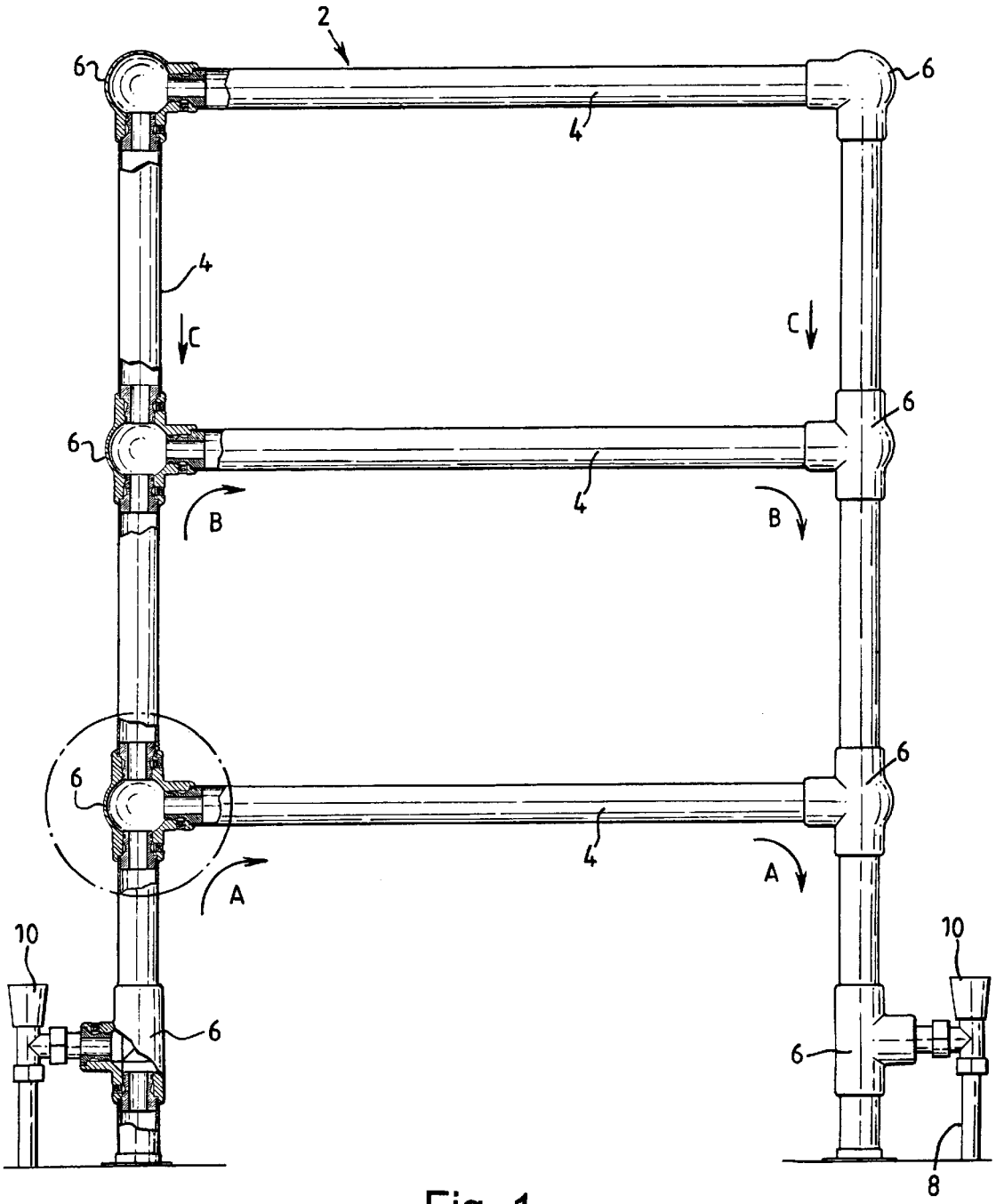
FIG. 1 shows a schematic representation of a towel rail assembled by the modular construction of the present invention.
Figure 2:
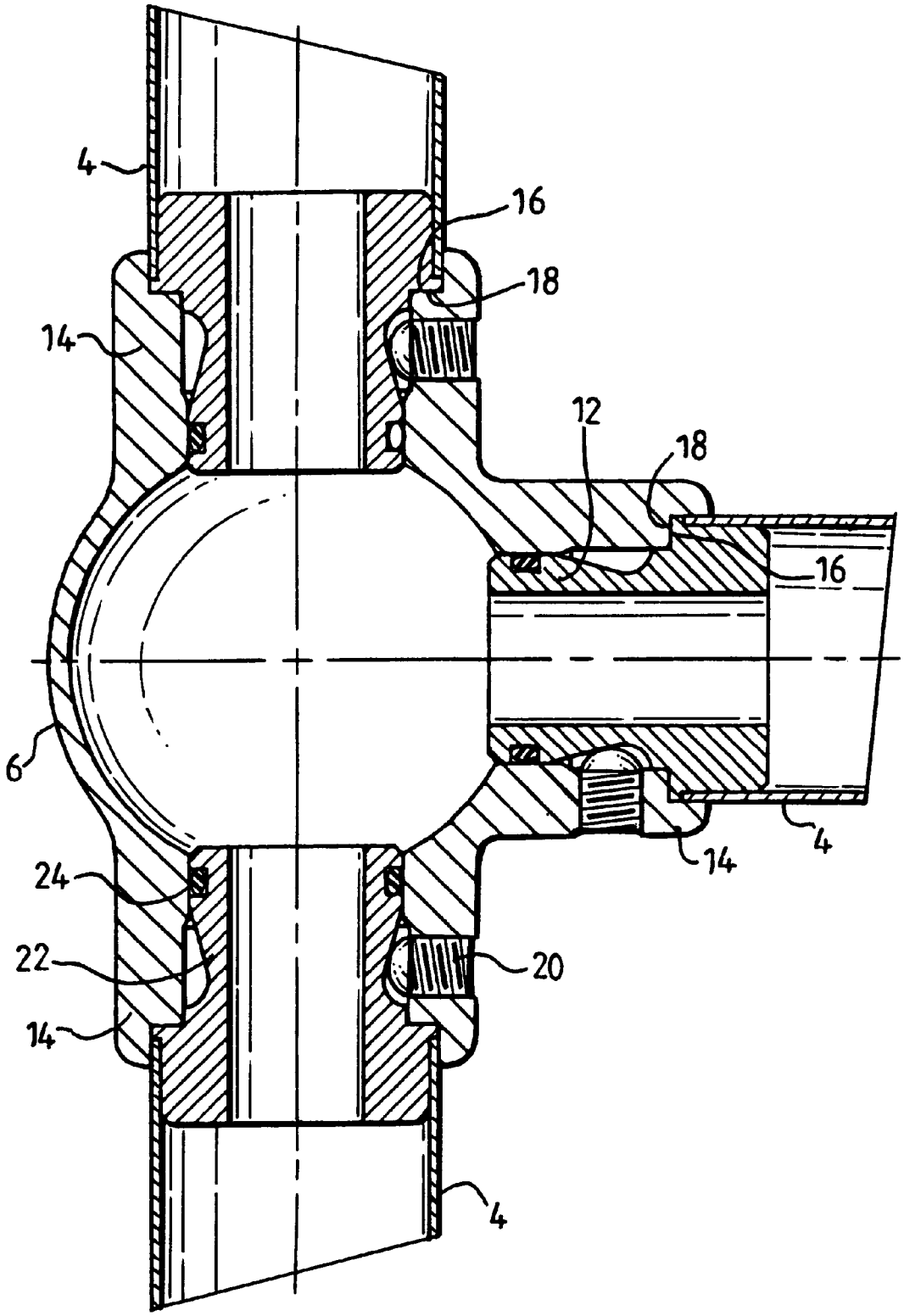
FIG. 2 shows in detail the feature of FIG. 1 which has been circled.

Referring now to both FIGS. 1 and 2, it can be seen that a towel rail shown generally as 2 comprises a plurality of discrete connection pieces, in this case hollow pipes 4 each of which is coupled to a connection piece, in this example a metallic connector 6. It will be appreciated that various different forms of metallic connector 6 are possible and in the present example only two types namely a right angle connector and a "T" connector are shown for clarity. Many other forms of connector are available and will be readily known to those skilled in the art.

The left hand side of FIG. 1 shows part-sectional views of each of the metallic connectors 6. The towel rail is coupled at either end to part of a hot water central heating unit (not shown). The valve stems 8 and the valves themselves 10 are shown in FIG. 1. The valves are used to control the flow of hot water from one of the valve stems 8 to the other of the valve stems 8 in a desired manner. By opening or closing either of the valves 10 a user may therefore control whether the towel rail 2 is heated or not by controlling the flow of hot water from one valve stem 8 to the other valve stem 8. When the valves 10 are open the water will flow through each of the branches marked A, B and C as shown in FIG. 1. Further discussion of the flow of water around each of the branches A, B and C will not be discussed herein as this is well known within the art.

Referring now particularly to FIG. 2 it can be seen that each hollow pipe 4 has at an end thereof a male projecting portion 10. Also, in this example, a metallic connector has, at each portion thereof adapted to be connected to a hollow pipe 4, a female projecting portion 14. Although in this example a hollow pipe 4 has a male portion 12 at an end thereof and a metallic connector 6 has a female portion 14 at an end adapted to be connected to a corresponding hollow pipe 4, this need not necessarily be the case. The invention will be equally efficacious if a hollow pipe 4 has a female end and a metallic connector 6 has a male end. For reasons of clarity however this particular possibility is not shown herein.

The male portion 12 is formed as an annular flange depending from the main body of the pipe 4. An annular step 16 is formed at the junction between the body of the pipe 4 and the male portion 12. Similarly an annular step 18 is formed on the female portion 14 such that both steps 16 and 18 mate in tight relationship when the pipe 4 is inserted into the connector 6. Furthermore annular steps 16, 18 help the user locate an accurate seating of the pipe 4 within the connector 6 by simply feeling this abutment between the steps taking place.

Once a pipe 4 has been inserted into a connector 6, then clearly some means of locking together is necessary. This presents the pipe 4 and connector 6 coming apart under pressure of hot water. This achieved by way of a locking means engaging the pipe 4 and the piece 6 so as one cannot be removed from the other. In this example a locking means comprises a grub screw 20. Once a pipe 4 has been fully inserted into a connector 6 and the two annular steps 16, 18 are abutting each other, then the user simply tightens up grub screw 20 until this is fully home. Removal of the pipe from the connector is then no longer possible unless the grub screw 20 is untightened.

To further ensure that the grub screw mates with the pipe 4 in rigid relationship thereby to prevent the pipe 4 being removed from the connector 6, the male portion 12 is preferably formed with a chamfered recess 22 so that when the grub screw 20 there abuts removal of the pipe 4 from the connector 6 is no longer possible. This is most important if, for example, the grub screw 20 works itself loose slightly over time.

In the event that the male and female portions 12, 14 of the pipe and connector 4, 6 respectively are reversed i.e. the connector 6 has a male portion and the pipe 4 has a female portion, then the use of the grub screw and a chamfered recess would still be advantageous. All that is required in terms of the locking of the pipe 4 to the connector 6 is that a locking means passes through one of these and contacts the other so that relative movement therebetween may not be effected.

In order to form a fluid-tight seal between the pipe and the connector 6, an O-ring is fitted therebetween. In the examples shown, an O-ring 24 is formed around the male portion 12 of the pipe 4 and sits snugly within the female portion 14 of the connector 6.

In the above example the metallic connectors are formed from a die-cast brass piece. The hollow pipes 4 may also be of brass and the O-rings 24 are formed of heat resistant material. The O-rings may be inserted into the female portion 14 of the connector 6 instead of being formed around the male portion 12 of pipe 4.

The present invention therefore lends itself readily to an adaptable modular-construction towel in which the finished product may take whichever form the user thereof desires. Removal or insertion of different pieces and branches for the flow of fluid therethrough are readily obtainable.

The present invention, whilst most readily lending itself to a hot water system may equally well be employed in a towel rail which is oil-filled. In this instance, the towel rail could be heated by utilizing an electric heating element within the pipes 4 and connectors 6. Those skilled in the art will appreciate that this is equally efficacious as applied to the present invention.

The present invention therefore also provides for a kit of parts to enable a towel rail of modular construction to be assembled.

What is claimed is:

1. A kit for a modular construction rack comprising:

a plurality of pipe members having predetermined lengths;

a plurality of discrete connection pieces, each being adapted to connect together the plurality of pipe members, said connection pieces being adapted to connect pipe members in one of an in-line and right angle configuration, said pipe members having a different size than said connection pieces to allow said pipe members and connection pieces to fit into each other;

an O-ring attached between said pipe members and said connection pieces to form a water-tight seal therebetween;

a screw that holds said pipe members and said connection pieces together; and a water supply coupling connectable to a source of water supply whereby when the kit is assembled, water from said water supply flows through said water supply coupling said pipe members and said connection pieces.

2. A modular construction towel rack comprising:

a plurality of pipe members;

a plurality of discrete connection pieces being arranged and constructed to releasably couple said pipe members to each other in one of an in-line and a right-angle configuration to form an assembled towel rack, said connection pieces forming a water tight joint with said pipe members said connection pieces and pipe members having different diameters and fit into each other;

an O-ring forming a water tight seal between said pipe members and said connection pieces;

a screw attached to one of said pipe members and connection pieces to removably lock said pipe members and connection pieces together; and a water supply coupler that couples said pipe members to a hot water supply to allow water from said water supply to flow through said pipe members and connection pieces to heat said towel rack.

3. A modular construction towel rack according to claim 2, wherein the discrete connection pieces include T-shaped connection pieces.

4. A modular construction towel rack according to claim 2, wherein one of the pipe members and the connection pieces includes a male portion and the other of the pipe members and connection pieces includes a female portion.

5. A modular construction towel rack according to claim 2, wherein one of said pipe members and said connection pieces includes a chamfered surface against which said screw abuts.

6. A modular-construction towel rack according to claim 2, wherein an O-ring is fitted between a pipe member and a connection piece, to provide a fluid-tight seal therebetween.

7. A modular-construction towel rack according to claim 6, wherein said O-ring is fitted to either an end of a pipe member or an end of a connection piece.

8. A modular construction towel rack according to claim 2, wherein one of the plurality of pipe members includes a male portion and one of the plurality of connection pieces includes a female portion.

9. A modular-construction towel rack according to claim 8, wherein an O-ring is fitted to the male portion of a pipe member.

10. The modular construction towel rack of claim 2 wherein said connection pieces are hollow to allow fluid to flow freely through said pipe members.

11. The modular construction towel rack of claim 2 wherein said pipe members and said connection pieces include smooth tubular external walls through their lengths, said walls being uninterrupted by any features.

12. The modular construction towel rack of claim 2 wherein said pipe members have a smaller diameter then said connection pieces.

13. The modular construction towel rack of claim 2 wherein said screw is a grub screw and wherein one of said pipe members and connection pieces has an outer surface with an annular groove and said grub screw is attached to the other of said pipe members and connection pieces, said grub screw engaging said annular groove to allow said pipe members and connection pieces to be coupled at any arbitrary angle about the axis of the pipe members.

* * * * *